US005743177A

United States Patent [19]

Wostbrock

[11] Patent Number: 5,743,177

[45] Date of Patent: Apr. 28, 1998

[54] ENHANCED CROSS-DIRECTIONAL CALIPER CONTROL SYSTEM

[75] Inventor: Edward M. Wostbrock, Guyton, Ga.

[73] Assignee: Union Camp Corporation, Wayne, N.J.

[21] Appl. No.: 608,660

[22] Filed: Feb. 29, 1996

[51] Int. Cl.[6] ..... D21G 1/00

[52] U.S. Cl. ..... 100/47; 100/163 A; 100/329; 100/331; 100/332

[58] Field of Search ..... 100/47, 161, 162 R, 100/162 B, 163 R, 163 A, 327, 329, 331–333

[56] References Cited

U.S. PATENT DOCUMENTS

| | | | |
|---|---|---|---|
| 2,312,310 | 3/1943 | Bradner et al. | 100/163 R |
| 3,691,940 | 9/1972 | Hays et al. | 100/47 |
| 4,114,528 | 9/1978 | Walker | 100/47 |
| 4,370,923 | 2/1983 | Schmidt . | |
| 4,384,514 | 5/1983 | Larivë et al. | 100/47 |
| 4,480,537 | 11/1984 | Agronin et al. . | |
| 4,498,383 | 2/1985 | Pav et al. | 100/329 |
| 4,573,402 | 3/1986 | Sharma et al. . | |
| 4,653,395 | 3/1987 | Verkasalo . | |
| 4,736,678 | 4/1988 | Stotz . | |
| 4,791,863 | 12/1988 | Vähätalo | 100/47 |
| 4,903,517 | 2/1990 | Van Haag et al. . | |
| 4,982,334 | 1/1991 | Balakrishnan | 100/161 |
| 5,029,521 | 7/1991 | Pav et al. . | |
| 5,236,640 | 8/1993 | Heiderich et al. . | |
| 5,427,021 | 6/1995 | Conrad . | |

*Primary Examiner*—Stephen F. Gerrity
*Attorney, Agent, or Firm*—Aufrichtig Stein & Aufrichtig, P.C.

[57] ABSTRACT

A cross directional caliper control system for a calender. A coarse caliper control mechanism adjusts the pressure over a first range of values. A fine caliper control mechanism adjusts the pressure over a second range of values, where the second range of values is smaller than the first range of values. Sensors sense the dimension of the paper web passing through the calender. A control mechanism coupled to the coarse calender control mechanism, the fine calender mechanism and the sensors controls the caliper across the width of the paper by varying the nip pressure with both the coarse caliper control mechanism and the fine caliper control mechanism to shift the variability of the caliper so that it corresponds to nip pressure adjustments within the second range of values. Bumpless adjustments of the coarse control mechanism are made by making counteracting adjustments to the fine control mechanism.

11 Claims, 8 Drawing Sheets

ENHANCED CROSS-DIRECTIONAL CALIPER CONTROL SYSTEM

BACKGROUND OF THE INVENTION

The invention is generally directed to a control system for cross-directional caliper control and density control and a process for implementing such control. In particular, the invention is directed to a multi-stage control system and process for controlling caliper and density in connection with a calendering process on a paper web.

Paper manufacturing equipment usually includes a series of two or more rolls defining one or more nips for running webs of paper or other laminar materials through them. Typical examples of such machines are called calenders (including super calenders) and glazing machines.

An important post-manufacturing treatment of paper is calendering which, when performed as a separate working step, is generally referred to as machine calendering or super calendering. In machine calendering the web is passed through one or more press zones or nips formed by rolls having hard and smooth surfaces. In the case where the web is passed through several nips, the calender rolls are usually journalled one above the other so that they can move freely in a vertical direction with respect to the bottom roll which is mounted with a fixed axis of rotation to thereby form a multi-roll vertical calender. Calendering may also be done with as few as two rolls. In a two roll calender, one roll would be fixed and the other would be loaded.

Important goals of calendering are to provide the paper with the desired smoothness and glaze and to adjust the thickness and bulk of the paper to desired levels. A related goal is to equalize the thickness of the web in the transverse direction so that the profile of the web is even. Other functions are carried out by calendering, as are well known.

The surface or nip pressure present in the press zone (nip) is an important variable in the calendering operation. The higher the pressure, the higher is the effect of the calendering on the thickness and smoothness of the paper. On the other hand, an excessively high pressure will negatively impact upon the physical characteristics of the web, compressing the paper.

As the calendering process operates on a web of paper in connection with a paper manufacturing process there is a variability in the characteristics of the web as it passes through the calendering. The calendering of webs in high speed paper machines often results in detrimental barring of the web which is difficult to avoid. Specifically, patterns of transverse depressions or bars are formed in the web which are clearly visible and which repeat at regular intervals. Such bar patterns are also clearly visible in the thickness profile of the web in the machine direction. Barring results from oscillations of the calender which cause variations of the linear load in the nips.

Unfortunately, ideal conditions in which the linear load across the web is constant in each nip of the calender and in which the properties of the web being introduced into the calender, such as thickness and density, maintaining a uniformity in both the longitudinal and transverse directions never actually occurs in practice. Also, calender rolls cannot be ground so as to be perfectly straight nor does the convexity curve of the rolls precisely follow their deflection curves. Thus, variations in the properties of the paper web result from both the web end, as well as the drawing section of the paper machine. In order to compensate for these real world variations in the properties of the paper web, adjustments must be made in the operation of the calender. These variations may be reduced by adjustment of the nip pressure at different bands across the transverse dimension of the web.

If a region of the web in a band along the transverse direction is thicker than other regions an increased linear load will exist in the calender nip at this region. This has the effect of elevating the temperature of the calender roll in this region, thereby increasing the diameter of the rolls due to thermal expansions, which also increases the heat generation. This thermal expansion has the effect of decreasing the caliper and thus partially self correcting the variation in the web thickness.

Generally, it is known to adjust manually the calender caliper at the ends and the crown of the calender roll by a mechanical or hydraulic system. This variation is generally operated under an operator's manual control which is difficult to accomplish, requires a skilled and experienced operator and requires constant attention by the operator. This control is only useful for gross variations in the caliper and density characteristics of the web. Thus, there is a need to improve the control of the caliper and density control under automated controls.

In addition, because of the variation in the web characteristics across the transverse direction of the calendering machinery there has been a need for finer control of the caliper and nip pressure in smaller bands across the transverse direction of the calendering rolls. In an effort to provide finer control of the caliper and nip pressure, various heating devices have been utilized in connection with one or more calendering rolls. The heating devices operate by increasing the temperature of the calendering roll, which under known thermal expansion coefficients causes a proportional increase in the diameter of the calendering roll as the temperature is increased and a reduction in the roll diameter as the temperature is reduced. An increase in the diameter of the calendering roll has the effect of decreasing the caliper and also increasing the nip pressure.

Current systems for heating the roller include those known in the prior art for heating the calender rolls by electromagnetic induction whereby a magnetic flux is externally applied to the mantle of the calender roll by means of a magnetic shoe device spaced from the calender roll mantle by an air gap. Magnetic flux induces eddy currents in the roll mantle which, in turn, generate heat in the mantle due to the electrical resistance of the mantle. Such known magnetic shoe devices include several core components situated in side-by-side relationship which can be adjusted to, in turn, adjust the heating effect cores in the axial direction of the calender roll.

Other arrangements include those in which heating coil elements are separated from the calender roll by an air gap and heat is applied to the calendering roll in a series of side-by-side bands across the transverse direction of the calendering roll by the heating elements which are situated so as to apply hot air to the calendering roll. The heated air devices utilize a series of sensors which measure the thickness and density of the web and then adjust the caliper and nip density in response to the sensed variations in web characteristics. These mechanisms allow automated fine control of as many as twenty to fifty separate bands across the transverse direction of the calendering roll. However, the range of variability of the caliper and nip pressure based upon thermal expansion of the calendering roll is fairly limited.

As a result of the limited range of variability of the heat based adjustment to the caliper and nip pressure, some or all of the bands of adjustment may be beyond the range of the variability of the heating system adjustment and are thus ineffective in adjusting the characteristics of the web in an effective fashion.

Accordingly, there is a need for an improved, automated control system and process for controlling the caliper and nip density in connection with the calendering process such that the mechanical or hydraulic coarse caliper adjustment and the fine, temperature based caliper adjustment are controlled in an integrated fashion which maximizes the utility of the fine caliper control and minimizes variations in the web characteristics.

SUMMARY OF THE INVENTION

The invention is generally directed to an improved control system for varying the caliper and nip pressure in a calender, super calender or machine calender by monitoring the thickness and density of the paper web following the calendering operation and adjusting the mechanical or hydraulic gross caliper and nip density adjustment when the fine, heat based caliper adjustment has more than a specified amount of its bands at one of the extremes of its variability range.

The invention is also directed to a process for controlling the variation in caliper control and nip pressure by monitoring the web characteristics following the calendering operation and adjusting the fine caliper control by temperature variations and by modifying the gross, mechanical or hydraulic caliper control when variability of the fine control is ineffective.

Another goal of the invention is to provide an improved control system for calendering operations in which on-the-fly adjustments are made to the calendering control and density control features in a bumpless fashion which increases the sensitivity of control and increases the range of variations dealt with in practice.

A further goal of the invention is to provide an improved process for controlling variations in web characteristics in a calendering machine whereby fine and gross controls are observed, fine temperature based caliper control is implemented across a range of bands across the transverse direction of the calendering rolls and automated sensing adjusts the gross and fine caliper controls to maintain the calender caliper gross adjustment at a level which will result in variations within the fine control range.

Still another goal of the invention is to provide an improved control system which provides bumpless adjustment of the coarse caliper control by providing corresponding adjustment to the fine caliper control and which restricts variability in a given time period such that the web is not damaged or broken and steady state conditions return prior to further gross adjustment.

Still a further goal of the invention is to provide an improved means of linking by computer control a fine caliper control mechanism which controls caliper variations in a sheet of paper by heating the calender roll in the paper machine with a gross caliper adjustment which varies caliper by the mechanical loading of the calender stack independent of the fine control system wherein the fine caliper control is most efficient in controlling caliper variation over small areas of the sheet and the mechanical loading caliper variation is most effective in controlling caliper variation over large areas of the sheet.

Still yet another goal of the invention is to provide improved paper product uniformity by slowly changing the nip load balance of the front and back coarse calender roll loading and similarly controlling swimming roll or other controlled crown roll's pressure so as to allow the thermally actuated calender control mechanism to remain within their narrower operating ranges.

Still yet a further goal of the invention is to provide coordinated control of a fine and a coarse caliper variation system in which the control system monitors whether the thermally reactive actuators are at the limits of their ranges of variability or trending away from the centerline of the current variability and evaluates whether nip loading should be changed, at one of the regions of variability of the mechanical or hydraulic calender variability system.

Yet still a further goal of the invention is to provide an improved process for adjusting caliper and nip pressure in a calendering operation so that variations in web thickness and density are minimized and maintained within acceptable parameters.

Yet still another goal of the invention is to provide an improved process for adjusting caliper and nip pressure to maintain product uniformity by adjusting both the fine and the coarse caliper controls in a way which minimizes the effect of the coarse control variation on the web output and maintains consistent output production.

Still other goals and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF PREFERRED EMBODIMENTS

Figure 1:
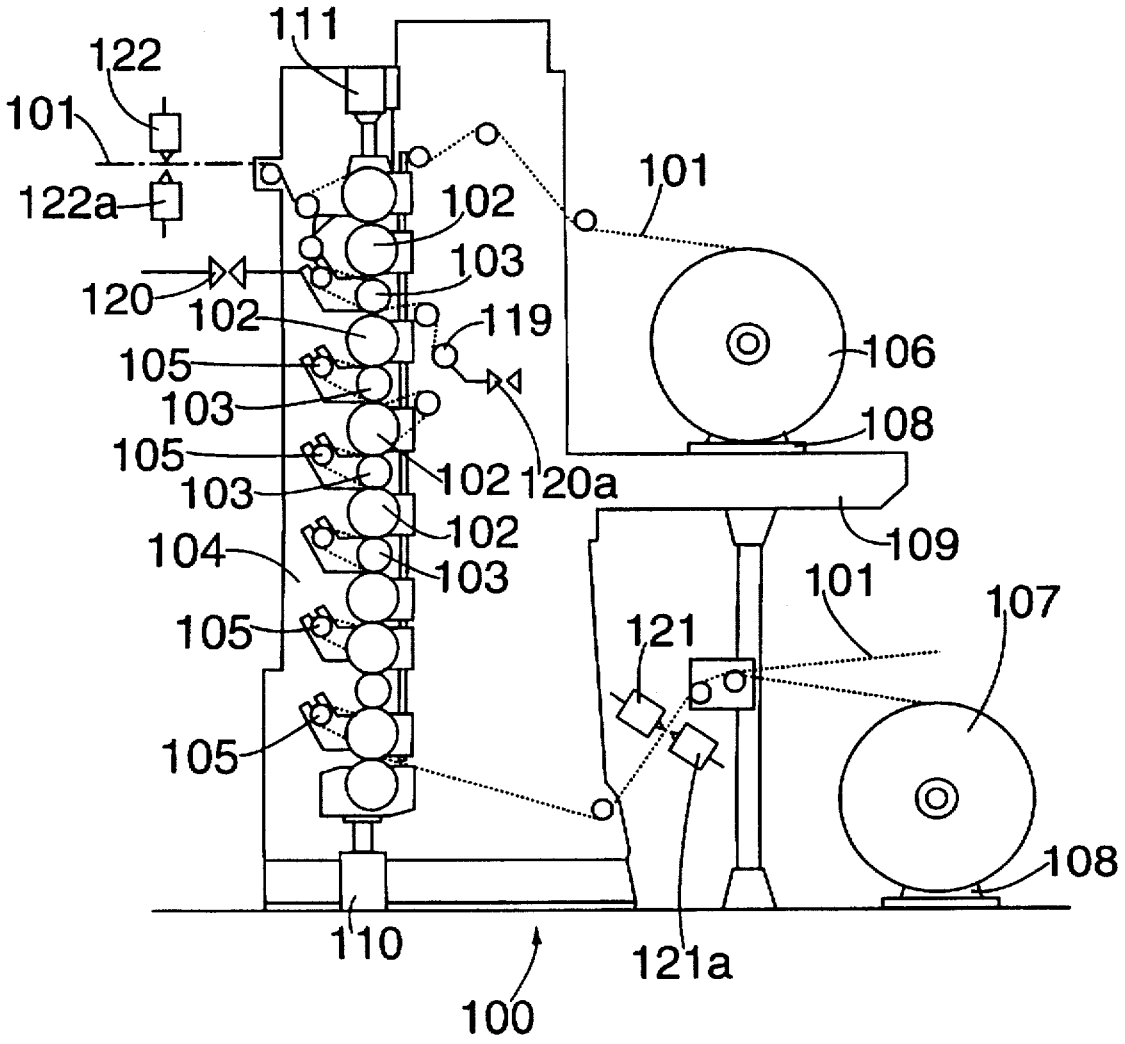
FIG. 1 is a side elevational view of a calendering stack in accordance with the invention.

Reference is first made to FIG. 1 wherein a calender, generally indicated as 100 constructed in accordance with a preferred embodiment of the invention is depicted. Like elements are represented by like reference numerals. Calender 100 is used for glazing both sides of a strip of paper 101 and has roller part rollers 102 and elastic rollers 103, which, as FIG. 1 shows are mounted parallel to each other, lie one above the other in a calender frame 104 and are vertically shiftable, whereby the hard and elastic rollers 102 and 103 in both the upper and lower portions alternate with each other, so that the roller nip through which the paper strip is guided is always formed by one hard roller 102 and one elastic roller 103. On one half, one side of the paper strip 101 lies against the elastic roller 103 in each roller nip, and on the other half, the other strip of the paper strip lies against elastic roller 103, so that the paper strip is glazed on both sides.

To the extent that wide rollers 105 or wider rollers are necessary to guide the paper strip 101, they are either arranged directly on the calender frame 104 or in support arms which project from the mounting bases of the rollers 102 or 103, as shown in FIG. 1.

For a discontinuous method or operation, i.e., for removing the paper strip 101 from a roller 106 and winding a paper strip unto a roller 107 after glazing, roller stands 8 are provided which, as shown in FIG. 1 are arranged in the exemplary embodiment adjacent to calender frame 104 on a platform 109 or the floor. But the calender can also be utilized for continuous in-line operation, and this is the preferred embodiment, and is in this form arranged in line with the paper machine. For entry into the calender after exiting the calender, the paper strip 101 will thus have, for example, the course indicated by the broken lines in FIG. 1.

In their operational positions, the rollers 102 and 103 are held by two hydraulic cylinders 110, which act on the two mounting faces of the bottom roller. With the aid of stops against which the pistons of hydraulic cylinders 110 work, the bottom roller is held in a pre-determined position. In case of the paper tear or to exchange a roller, the hydraulic cylinders 110 are disabled so that all rollers 102 and 103, with the exception of the top roller, can be lowered to the degree necessary. In the lowered position, the rollers 102, 103 are held in place and supported from the calender frame 104.

The weight of the rollers 102 and 103, because of their vertically shiftable mounting, produces a minimal pressure on the roller nips. This pressure can be increased with the aid of a loading device, which in one embodiment acts on the top roller with a downward force and, in an exemplary embodiment, consists of hydraulic cylinders 111 which are capable of inserting small increases of downward force on the two mounting faces of the top roller.

While this is an exemplary embodiment of a calendering operation, the specific structure of the calendering stack is not critical to the functioning of the invention. However, the capacity to provide coarse, mechanical adjustments of the nip loading is essential to the invention.

Figure 2:
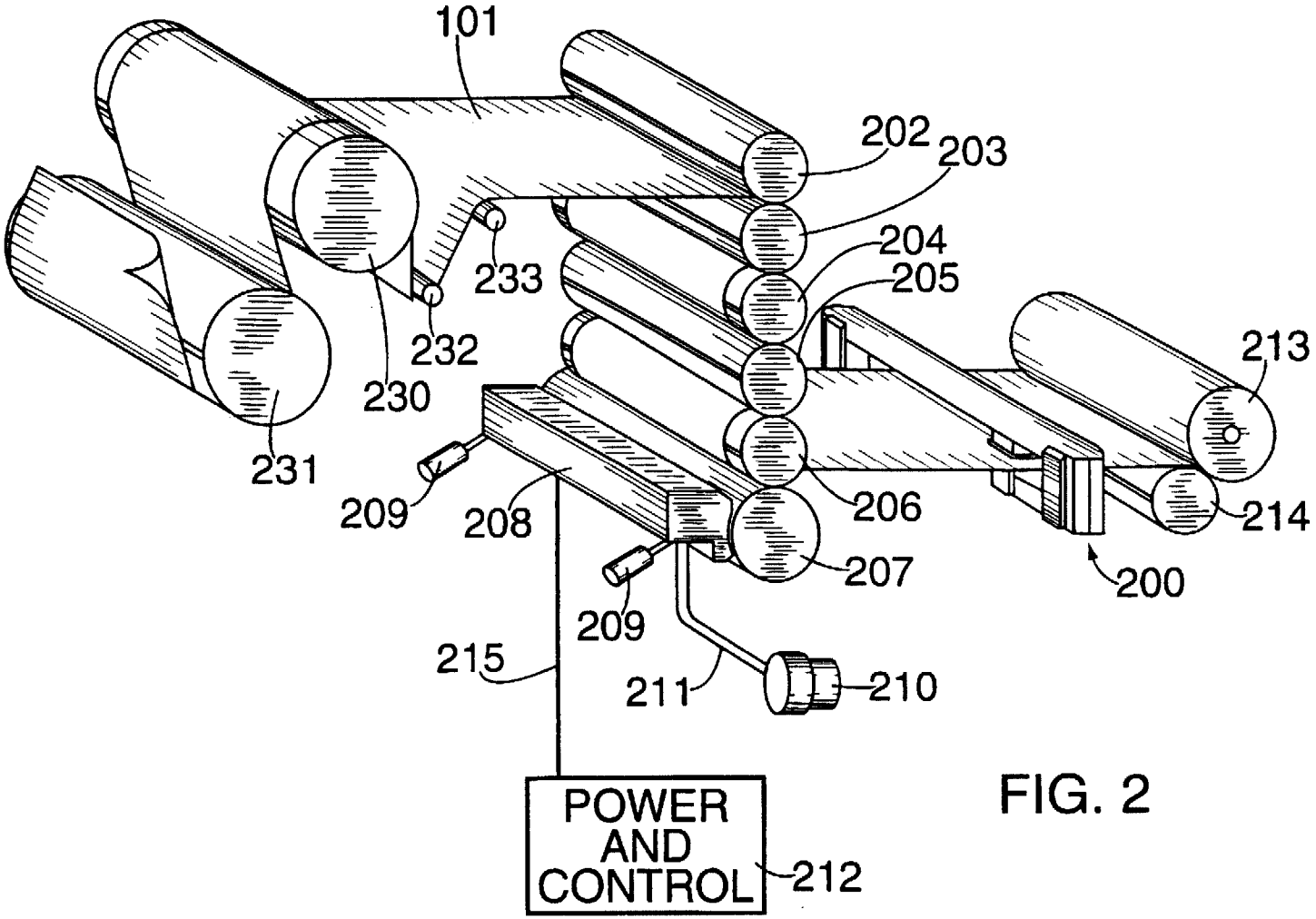
FIG. 2 is a perspective view of a calendering system in accordance with a preferred embodiment of the invention.

Reference is next made to FIG. 2 wherein a calender control system utilizing a thermal control system, generally indicated as 200, is depicted. Control system 200 includes a paper web 101 fed into the calendering stack by guide rolls 230, 231, 232 and 233. The calendering stack includes rollers 202, 203, 204, 205, 206 and 207. Thereafter, the web passes the calendering section through rollers 213 and 214 for further processing. The thermal control system includes a heat generating member 208, a retraction system, shown schematically as 209 for moving the heat generating member 208 from close proximity from roller 207. In addition, an air blower 210 and air duct 211 bring air into the heat generating member 208. Finally, power and control system 212, shown schematically as connected to the heat generating member 208 via connector 215. In addition to the signals and power going from power control system 212 to heating member 208, a series of paper web measurement covering each of the heating zones is passed back to parent control system 212.

Figure 3:
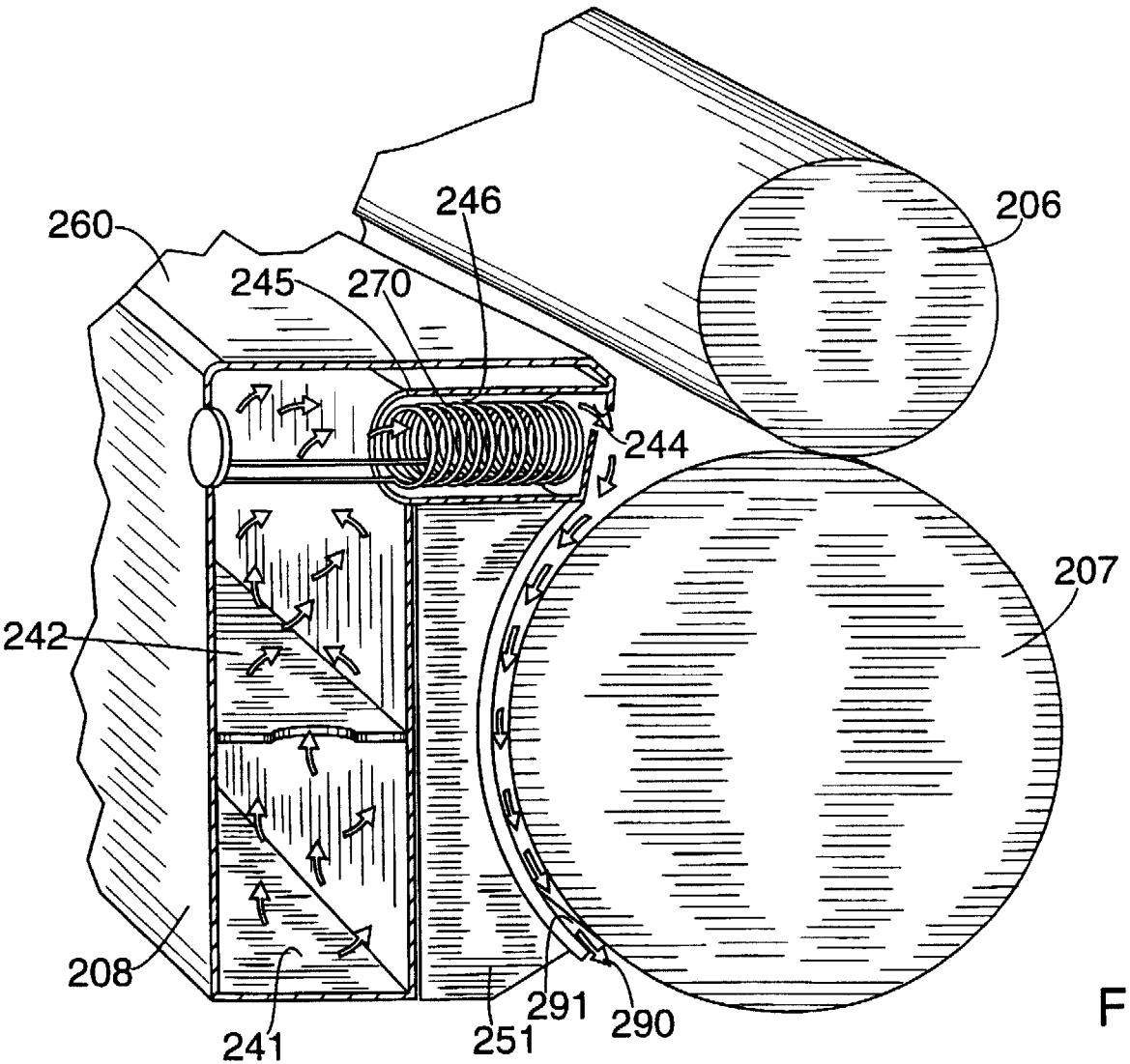
FIG. 3 is a partially cut-away cross sectional view of a thermal caliper adjustment system in accordance with a preferred embodiment of the invention.
Figure 4:
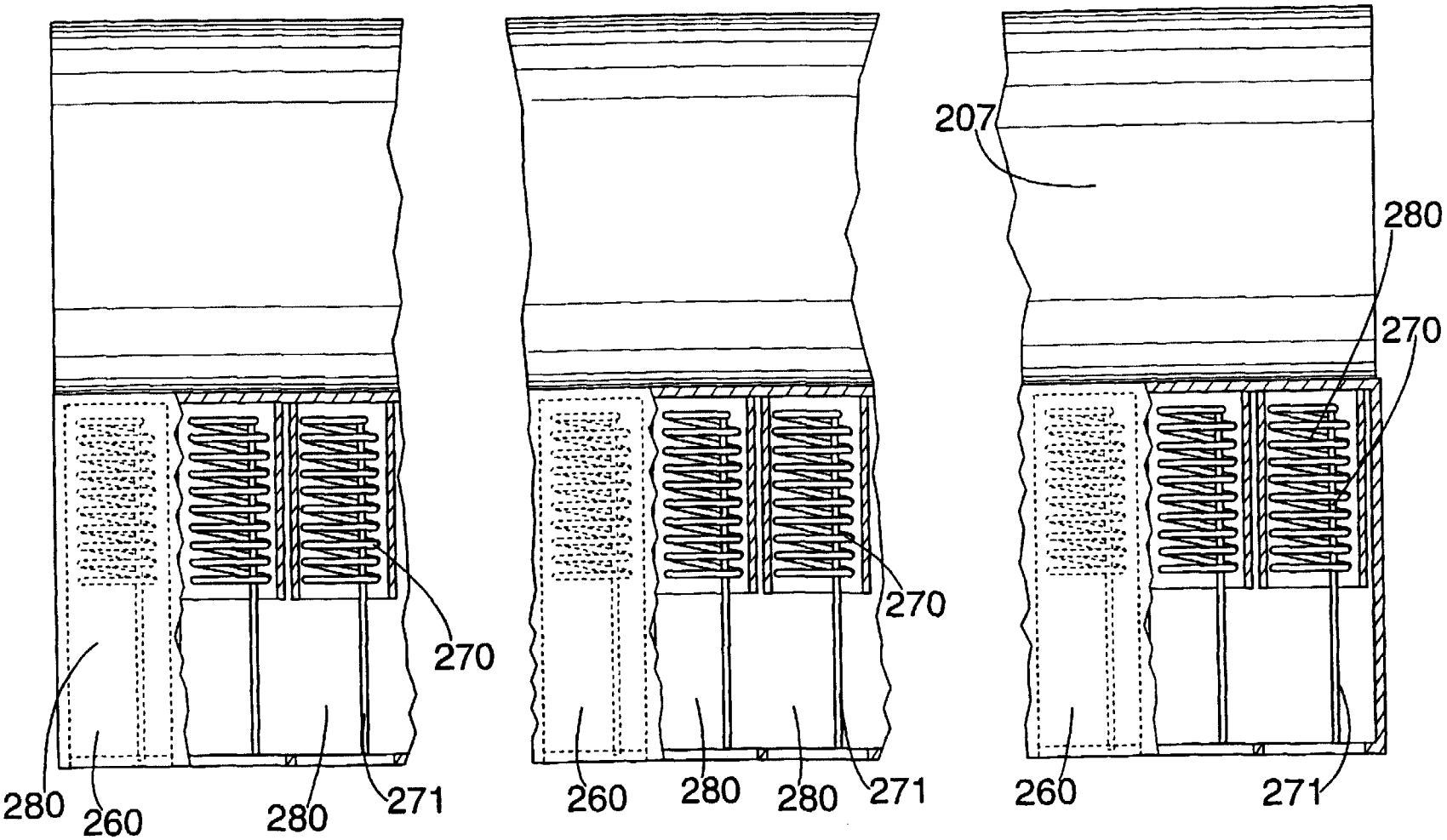
FIG. 4 is a top plan view, partially broken away and partially cut away of the thermal calendering adjustment system of FIG. 3.
Figure 5:
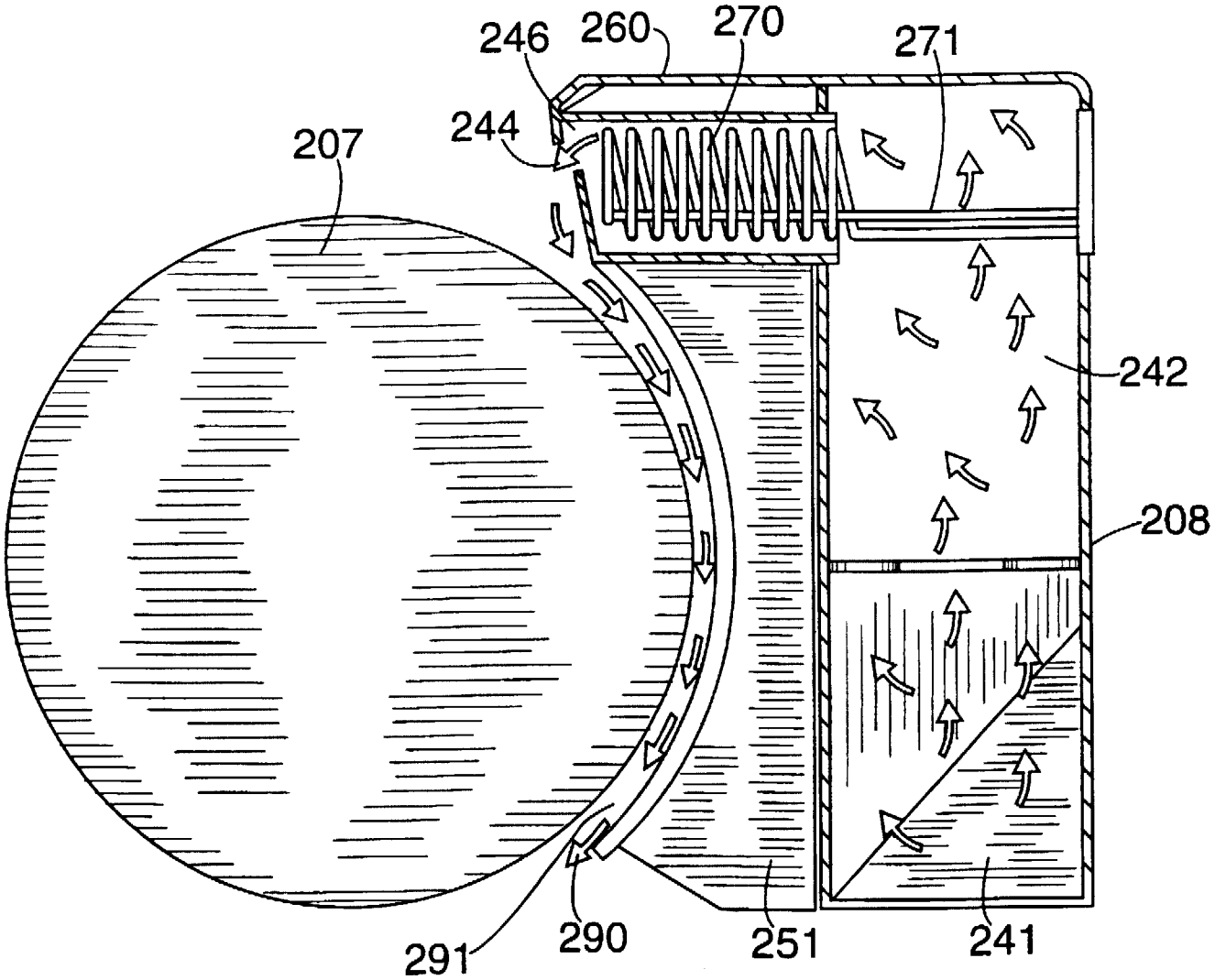
FIG. 5 is a side elevational view similar to FIG. 3 constructed in accordance with preferred embodiment of the invention.

Reference is next made to FIGS. 3, 4 and 5 wherein details of heating member 208 are shown in greater detail. Heating member 208 includes a housing wall 260 which incorporates a series of compartmentalized heating coils 270, each of which is powered by power cables 271, which are ultimately connected through connection 215 to power control system 212. In practice, there are a relatively large number of individual heater helmets spread in a transverse direction across the width of calender roll 207. As shown in FIG. 4, in which housing 260 is partially cut away to show the coils 270 and power cables 271, the individual heating coils 270 divide the calender roll 207 into a large number of bands, each of which corresponds to a single heating coil element 270.

The operation is better seen in FIGS. 3 and 5, where a cut away perspective view and a side elevational, partially cut away view of a heating unit are depicted. With reference to FIG. 3, air enters lower plenum chamber 241 from blower 210 and through air duct 211 having a generally upward flow. The air then circulates upward into upper plenum chamber 242 and then exits into a chamber 246 formed by chamber wall 245. Coil 270 sits within chamber 246. Chamber 246 opens to upper plenum chamber 242 on one end and has a small opening 244 at the other end facing calender roll 207. Heating member 208 has a rounded body 251 with a smooth surface layer 292 creating a smooth, relatively uniform narrow gap 291 between surface 292 and the outer surface of calender roll 207. In a preferred embodiment the gap is about one half inch or less. The air flows from upper plenum chamber 242 through heating chamber 246 and in and around coil 270 before passing out through opening 244 and following air path 290, shown by the arrows in gap 291. The direction of the air flow 290 is generally opposite to the direction of the rotation of calendering roll 207, which provides for an improved circulation of heat around calendering roll 207. The air flow 290 covers about one quarter of the circumference of calendering roll 207 so that good heat transference is achieved. As best seen in FIG. 5, the air flow out of chamber 246 and then down through gap 291 in the direction of arrows 290. Opening 244 extends for most of the width of the band covered by each of heating unit. Each of the heating elements 280 has a separate coil, coil chamber 246 and opening 244 covering a well defined cross-dimensional zone for precise temperature control of the calender roll 207.

Calender roll 207 is made of a metal material which exhibits expansion and contraction in accordance with a thermal profile such that increases in temperature cause the calender roll to expand in a predictable fashion. When calender roll 207 expands under the influence of increased temperature, its radius likewise expands and has the resultant effect that the caliper is reduced and the nip pressure increased between roll 207 and adjoining roll 206. Likewise, as the temperature of calender roll 207 decreases, the radius of the calender roll 207 is reduced, thereby increasing the caliper and decreasing the nip pressure between rolls 207 and 206. Because the length of roll 207 along the transverse direction is divided into a series of bands, each of which is served by a different heating control element, the caliper between rolls 207 and 206 can be varied independently for each of the separate zones. In practice, roll 207 in operation has an ambient temperature substantially above the ambient air temperature of approximately 100° F. With no current running through the coil or turbo heaters the air being blown through the system on a constant basis will have a temperature at approximately 100° F. which will have the effect of cooling roller 207. Likewise, as more electrical current is passed through the coil 270 under the control of current control system 212, the coils will heat up, due to the resistance of these elements, and the air passing through and around the coils 270 will be heated up to a maximum temperature of anywhere between 450° F. and 600° F. This temperature will have the effect of heating the calender roll 207 and causing thermal expansion and caliper reduction described above. The thermal control system operates in a fashion with calibration of the current flowing through the coils and resulting temperature such that accurate temperature and caliper control within the range of variability of the available temperatures can be carefully modulated across the transverse direction of calender roller 207.

In preferred embodiments of the invention there are between forty and eighty separate heating zones across the transverse direction of calender roll 207. In practice, the heating variability of heating units 280 produces in a preferred embodiment a range of caliper variation of about 0.3–0.5 mils end to end. The range of heating temperatures is then converted to a scale of 0–100 and the heating and current necessary to achieve this range of caliper variability is then divided into 100 intermediate values. By way of comparison, in a preferred embodiment the mechanical loading system has a range of variability of about 10.7–11.5 mils from end to end. Part of the range of variability of the mechanical loading system is related to changes in the basis weight of the paper being produced. In the mechanical loading system a variation in about 1 psi corresponds to a step. With the heating system variations of 0.1 psi correspond to a single step, and allow this variability across the dimension of the calendering roll.

Figure 6:
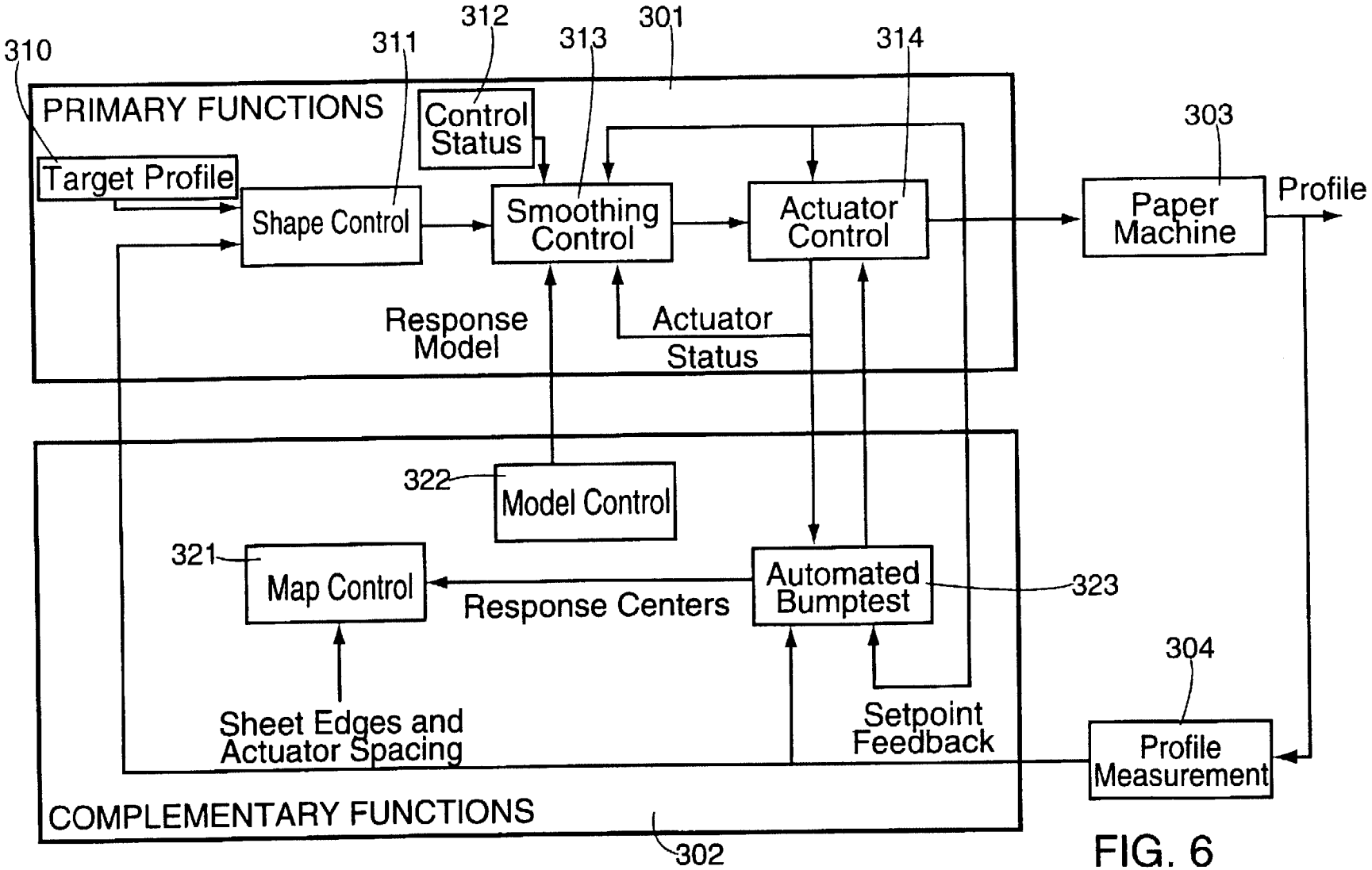
FIG. 6 is a block diagram of a control system for the thermal caliper control system in accordance with the invention.

Reference is next made to FIG. 6 wherein a flow chart block diagram of the thermal cross direction caliper control system. The features present in primary function box 301 and complimentary functions box 302 are part of the power control system 212 shown in FIG. 2. The primary functions of box 301 includes a target profile 310, shape control 311, control status 312, smoothing control 313 and actuator control 314. Complimentary functions of box 302 includes map control 321, model control 322 and automated bump test 323.

The primary functions 301 are coupled to the paper machine, identified as 303, and the web profile resulting from processing through the paper machine 303 is then measured by profile measurement 304 which in turn is fed back to the complementary functions box 302 and primary functions box 301. In this way, the profile of the paper web output from paper machine 303 is maintained within the desired parameters through the feedback control system composing primary and complimentary function controls 301, 302, paper machine 303 and profile measurement 304.

Primary function control 301 operates by utilizing a target profile input by an operator along with the actual profile measurement through a shape control module 311, in which an operator can select a default target rather than simply a flat profile. This allows the system to automatically generate a "smile," "frown," or any other desired shape to optimize paper runability in converting operations. The operator can also use the shape control strategy to compensate for non-process problems, such as a damaged calender roll, by adding an offset to the profile at the damaged location.

Next, the target profile modified by the shape control 311 is run through the smoothing control 313. The smoothing control 313 utilizes an optimization strategy which incorporates the process of response, actuator status and actuator constraints into a single control equation. This recursive optimization maximizes the control range while attempting to insure that the actuator limits are not exceeded. The controller also provides flexibility in control criteria and allows for minimization of the standard deviation of the profile, peak-to-peak variations in profile, or a combination of both. In this way, depending upon the control status, controlled by input of different types of smoothing of the target profile control can be implemented. Finally, the shape and smooth target profile is input into the actuator control, which then causes the thermal actuators to properly respond to modify the caliper and the pressure in paper machine 303.

In the complimentary functions control section 302 model control 322 utilizes automated bump test 323 procedures to provide on-line identification of the process model. By accurately modeling the process response the system can accurately compensate for overlapping actuating zones or coupling of effect from adjoining zones.

In addition, automated bump test 323, which receives inputs from the actuator control 314 and set point feedback, also from the actuator control output, is used with the map control 321 to automate the difficult and time consuming task of actuator mapping and insure that mapping is automatically adjusted. Through the automated bump test procedures, small changes are made to several actuators across the width of the machine. These changes are nearly imperceptible, so as not to produce off-spec paper, but are observable by the "system." When the bump test is completed, the results are compared to the current mapping and adjustments are made where necessary. This insures faster machine start-ups and consistent control performance besides changing process conditions. The map control 321 also receives as an input information relating to the sheet edges and actuator spacing to enable the remapping process.

This control system provided advanced cross direction caliper control for calender stack actuators such as the thermally actuated heating device of FIGS. 3, 4 and 5.

Figure 7:
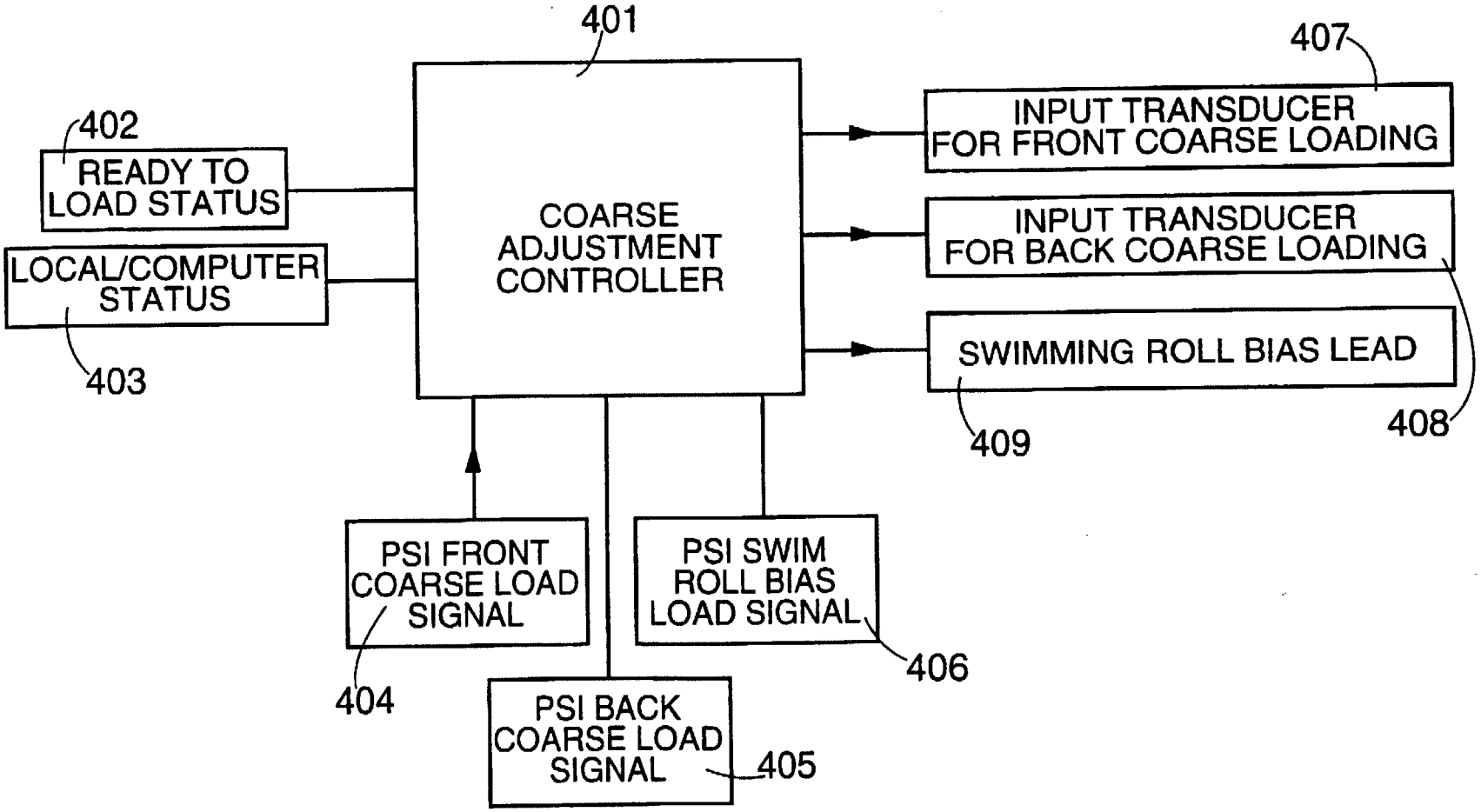
FIG. 7 is a block diagram showing a control system for the coarse caliper adjustment in accordance with a preferred embodiment of the invention.

Reference is next made to FIG. 7 wherein a flow chart diagram of a coarse load adjusting control for a caliper control system in accordance with the preferred embodiment of the invention is depicted. The control system is predicated upon three coarse controls in connection with the mechanical loading system. These are a front coarse loading control, a back coarse loading control and a swimming roll bias load control. A coarse adjustment controller 401 receives a pounds per square inch (PSI) front coarse load signal 404, a PSI back coarse load signal 405 and a PSI swimming roll bias load signal 406. Signals 404, 405 and 406 are analog signals which, in the preferred embodiment of the invention have a range of 4–20 ma. In addition, ready to load status input 402 and local/computer status input 403 are digital inputs. The local/computer status input 403 monitors the activation of coarse adjustment control between a manual or local control by an operator and the computerized control in accordance with input set points at control parameters. Ready to load status signal 402 monitors a series of conditions. It monitors whether there is a sheet break, whether the target profile is in the auto status, whether the grade and speed changes are active, whether the calender control is in the cascade mode and whether the basis weight change is active. The ready to load status signal is input only if the sheet break, grade change active, speed change active and basis weight change active values are negative and the thermal profile and auto calender control and cascade mode or input are present. If a sheet break is present, then the adjustment control is disengaged so that the machine can be restarted. The thermal profile must be in automatic mode so that it can be controlled based upon the movement of the coarse adjustment controller. If any of the grade change, speed change or basis weight change systems are active then it is inappropriate to adjust the calender roll loading until sufficient time has passed for the changes to stabilize within the system at which point the coarse adjustment controller can again modify the loading. Similarly, the cascade mode of the control system must be implemented in connection with the coarse and fine calender roll loading.

Figure 8:
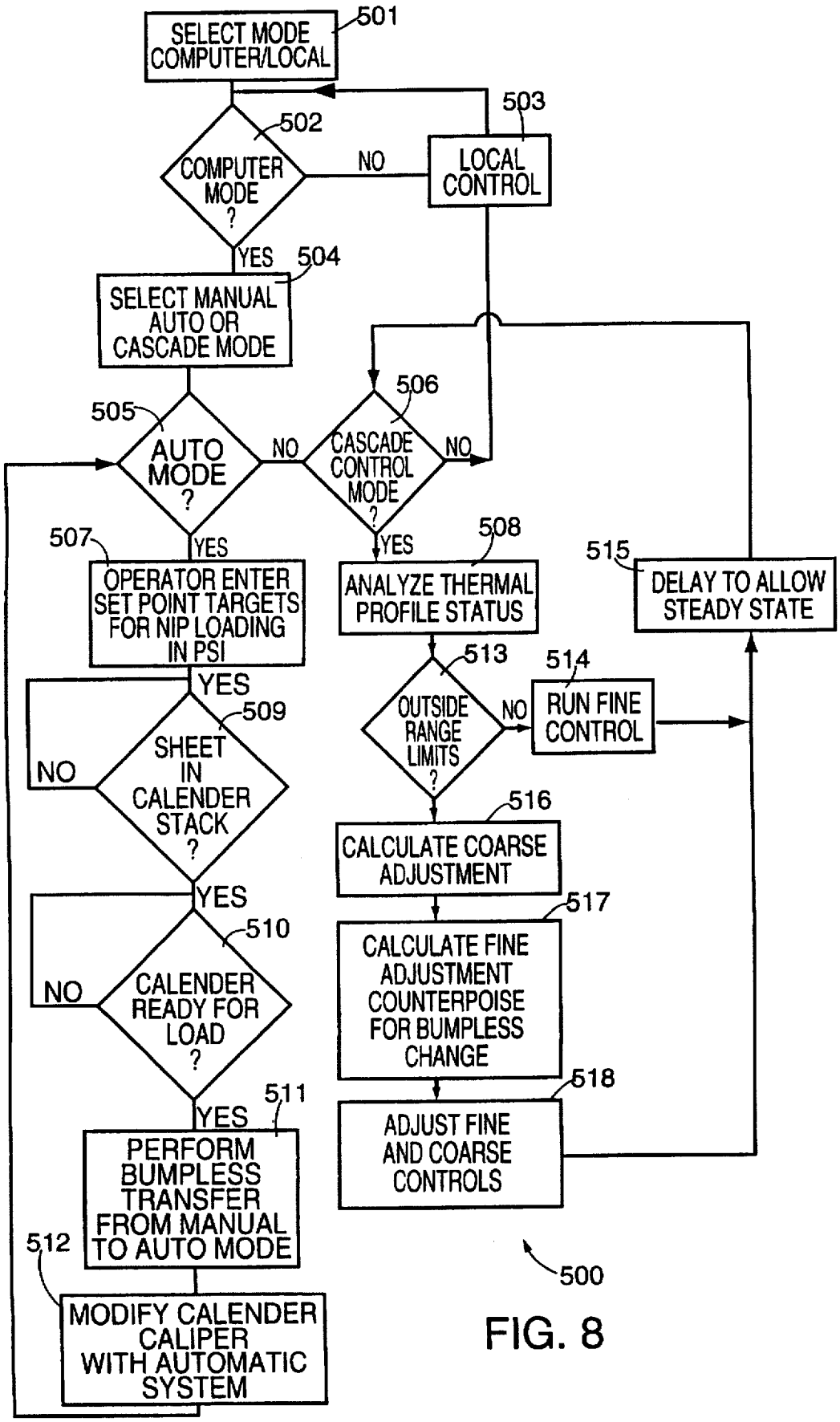
FIG. 8 is a flow chart diagram of the control system constructed in accordance with a preferred embodiment of the invention.

Reference is next made to FIG. 8 wherein a flow chart diagram of an integrated coarse and fine caliper control system, generally indicated as 500, constructed in accordance with a preferred embodiment of the invention is depicted. Control system 500 first requires a selection in box 501 between the computer mode and local mode of operation of the caliper control system. In decision box 502 the system determines whether the computer mode or local mode have been selected. If the computer mode has not been selected, control shifts to box 503 where local control is implemented. After local control is implemented the control system continues to check whether the mode has been changed to computer mode.

In the event that the computer mode is selected in decision box 502, control shifts to box 504 where the user selects either manual, auto or cascade computer controlled modes. In the event that the automatic mode is selected, decision box 505 shifts control down to box 507 where the operator enters set point targets for nip loading in pounds per square inch (PSI). Thereafter, the control system determines in decision box 509 whether a sheet is present in the calender stack. The control system stays at this point until a sheet is actually present in the calender stack. Next, once the control system has determined that there is a sheet present in the calender stack, the control system waits in decision box 510 until the calender is ready for loading. Once the calender is ready for loading and the sheet is present in the calender stack, control shifts to box 511 where the control system performs a bumpless transfer from manual to auto modes of operation. Thereafter, in box 512, the control system modifies the calendar caliper in accordance with the automatic system incorporating the fine caliper adjustment controls. Control then returns to decision box 505 to determine if the control system remains in the auto mode.

In the event that the control system determines in decision box 505 that the operator has not selected the auto mode, thus, the user has selected either manual or cascade modes, control shifts to decision box 506 where the determination is made whether the cascade control mode has been indicated. In the event that it has not and, thus, manual mode has been selected, control shifts to box 503 where local control is implemented.

However, in the event that the cascade control mode is selected, control shifts to box 508 where the control system analyzes the thermal profile status. By thermal profile status it is meant that the control system analyzes whether any of the separate thermal zones on the fine caliper control adjustment system are at one or the other of the ends of its range of variability. In other words, has the heat been turned up to the maximum amount or shut off completely, thus producing the greatest or least nip pressure possible with the fine caliper control system. Alternatively, and even more preferably, the control analysis in box 508 determines whether the range of variability by fine caliper control adjustment system is centered on the current setting. Even if none of the fine caliper adjustment members are at one or the other of the ends of its range of variability, but the adjustments vary from the centerline of the gross adjustment system by more than a predetermined amount or percentage, then the gross adjustment system is enabled to return to the centerline situation.

In box 508, the status of each of the separate zones of the fine controller are analyzed and reviewed to determine whether and how many ranges are at maximum or minimum values. Also, the analysis is conducted to see if the weighted average of all of the separate zones varies more than a predetermined or selectable amount or percentage from the centerline of the range of variability. In this way, the maximum usefulness of the fine caliper control system is enabled. If any of the separate zones are at the ends of their ranges of variability, than those zones are not adjusting the caliper and nip pressure to the sensed conditions. This condition should be avoided or minimized where ever possible.

Next, in decision box 513 it is determined whether more than a pre-selected number of the zones of the fine control system are at maximum or minimum levels or the centerline analysis suggests movement of the coarse control system. In the event that such a determination is made, this will indicate that the conditions have shifted to the extent that a substantial number of the fine control zones have ceased to function within their ranges of variability or those zones ranges of variability have been substantially decreased. This means that the coarse controller needs to adjust the nip pressure and the resultant caliper to bring more of the fine control zones within their ranges of variability and maximize the effective range of variability.

In the event that the determination is made that either none of the fine control zones or less than the threshold number of zones are at the ends of their range of variability, or the centerline of the fine control zones has not shifted appreciably, control shifts to box 514 where the fine control adjustment is allowed to proceed alone. Thereafter, control shifts to box 515 where a delay is imposed upon the system during which no changes may be made to allow the adjustments made on the controller to reach a steady state level prior to which further adjustment will be allowed. The delay is imposed to prevent additional stresses on the paper web which may damage or even break the web if too many adjustments are performed too quickly.

In the event that it is determined that more than the threshold number of zones of the fine control means are at the end of their variability ranges or the centerline has shifted appreciably, then this indicates that the coarse control must be implemented to adjust the mid-point of the range of variability of the fine control to a point which will allow a greater number of the fine control zones to vary within their adjustment ranges. Thus, in box 516 the control system calculates the coarse adjustment required to bring the fine control system back within its desirable parameters. This can be done either by selecting a standard movement and repeating the adjustment until sufficient loading or unloading has been performed, or by calculating the expected loading and doing this in one step. Generally, smaller steps are preferred. Next, in box 517 the control system calculates the amount of fine adjustment required as a counterpoint to the coarse adjustment so that the adjustment of the coarse control system does not provide a bump as the change is made to the loading by the mechanical coarse controller. This is accomplished by making a corresponding and opposite adjustment on the fine control system. In some cases the full amounts of the coarse control change cannot be implemented by the fine controller. However, generally the coarse adjustment is made in increments which can be counteracted by the fine control system. Finally, in box 518, the actual adjustments of the fine and coarse controls are implemented substantially simultaneously. Then, control shifts to box 515 where a delay is imposed on any further changes to allow the system to return to its steady state values. If on the next loop too many of the fine control zones are still at the end of their range of variability, or the centerline of the zones is still shifted, further coarse adjustment is implemented. However, in the event that the change in the coarse adjustment has returned the fine adjustment zones within their ranges of variability, only fine control is implemented thereafter.

In this way, in the cascade control mode there is integrated control of the caliper in a cross-dimensional fashion by the control system utilizing both systems in a fashion which increases the likelihood that the fine control, which is implemented across a large number of zones across the direction of the calender roll, can operate within their ranges of variability so that effective adjustment of the pressure and resulting caliper are achieved.

In practice, the calendering operation continues with the various factors influencing the resultant caliper of the paper as the paper machine is operated. Obviously, if the basis weight of the paper product being made is changed, the parameters of the nip pressure and resultant caliper are altered. These changes are a regular feature of the operation of a paper machine and the system must be able to deal with these types of gross variations without unduly effecting the operation of the calendering process or damaging the paper web as the changes are implemented. However, once the paper machine is producing a paper of a specified basis weight and other characteristics, it is presumed and expected that the caliper of the paper processed through the calendering operation will maintain a product uniformity, both along the machine direction and in the cross direction across the width of the paper web.

Operating conditions, irregularities and damage to the equipment, as well as other factors well known in the paper production industry cause the caliper to vary in undesirable ways, particularly across the width of the paper during the calendering operation. As a result, fine variations in caliper are reduced by use of a thermal or magnetic flux based fine cross-dimensional caliper control system. The thermal caliper control system described above is a preferred embodiment of such a fine control system. Other similar systems such as an internal pistons within a swimming roll or magnetic flux and others may also be used in connection with applicant's invention. The fine control system divides the width of the paper (cross-direction), into a series of bands, each of which may have fine adjustments to the nip pressure and resulting caliper to deal with local variations and problems with the caliper of the resultant paper. This approach is particularly useful in dealing with small, but still undesirable, variations in the caliper of the paper following calendering. When the range of the variability of the caliper variations is within a narrow band around the initial loading of the calender roll, the fine control caliper adjustment mechanism operates in an acceptable fashion. However, it is not unusual for conditions to change or for the loading situation to shift over time as the paper making operation continues. Under this circumstance, what happens is that many of the variations are greater than are adjustable with the fine caliper adjustment mechanism. In these cases the fine adjustment performs as much adjustment as possible but still does not bring the caliper in the effected zone or zones to the desired values. As the variations continue the fine caliper adjustment ceases to have any positive corrective effect or only a limited positive corrective effect on the caliper of the paper passing through the calendering operation.

By linking the coarse adjustment control and the fine adjustment control together, there is improved fine control of the caliper. The coarse caliper control has limited variability associated with it, usually merely having a front and back loading and, perhaps, a swimming roll or crown control variability in the middle of a roll. As such, the coarse control is not suitable for dealing with variations between narrow zones on the calender roll. On the other hand, the fine caliper control mechanism is very useful for dealing with small variations between different zones across the width of the calender roll, but poorly suited to dealing with large scale variations in nip pressure, particularly where the median nip pressure is not near the center of the range of variability of the fine control system.

In a preferred embodiment the caliper control system in accordance with the invention checks to determine whether any or more than a predetermined number of the fine control zones have reached one extreme or the other of their ranges of variability or the centerline of the fine control zones has shifted appreciably from the center of the range of variability of the fine control system. In the event that this has happened, the coarse control mechanism shifts the loading, either on the front, back or in connection with the crown control to adapt to this situation. To prevent undue stress on the paper during the calendering process as the changes are being made, a "bumpless" change is made by calculating and providing an adjustment to the fine control mechanism to counteract the effect of the coarse control mechanism. Thereafter, the fine control mechanism can then reestablish itself at appropriate values based upon the new steady state conditions which, hopefully, will be centered or nearer to the center of the range of variability of the fine control system. This will then improve the effectiveness of the fine control mechanism by keeping the variations within the range of variation which the fine control system can adjust.

In preferred embodiments, the fine control system is a thermally based adjustment mechanism, as disclosed above, in which there are between forty and eighty separate zones across the width of the paper. In a preferred embodiment, the triggering amount is a movement of the centerline of the ranges of variability of the separate zones such that at least 50 percent of the range of the variability is reduced, more preferably that 35 percent of the range of variability is reduced and even more preferably 15–25 percent of the range of variability is reduced. The triggering amount of adjustment zones at the ends of their ranges of variability, if only adjustment zone extremes are used is preferably zero percent, but may be between about 1% and 25% of the total zones to enable the coarse adjustment, and in a more preferred embodiment, between about 0% and 10% of the zones.

The control system is preferably implemented in connection with a computer in which the computer is programmed to control the coarse adjustment mechanism, the fine adjustment mechanism and the sensor elements which monitor the paper as it is processed by the calendering operation in accordance with conventional sensing technology. The programming of the computer controller may be modified to adjust additional systems other than the calendering operation. However, in connection with the calendering operation, the computer system also receives inputs from operators in connection with the acceptable ranges of variations in caliper and the preferred cut-off for engagement of the coarse control mechanism.

Accordingly, an improved cross-directional caliper control process and system in which variations in caliper are adjusted by interactive and integrated use of a coarse caliper control system together with a fine caliper control system and which has relatively bumpless adjustment, the coarse caliper adjustment mechanism is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A cross-directional caliper control system for a calender, comprising:

coarse caliper control means for adjusting the nip pressure in the calender over a first range of values;

fine caliper control means for adjusting the nip pressure in the calender over a second range of values, the second range of values being smaller than the first range of values;

sensing means for sensing the dimensions of the paper web passing through the calender;

control means, coupled to the coarse caliper control means, fine caliper control means and sensing means, for controlling the caliper by varying the nip pressure with both the coarse caliper control means and the fine caliper control means to shift the variability of the caliper so that it corresponds to nip pressure adjustments within the second range of values wherein the control means controls the coarse caliper control means based on input from the sensing means and controls the fine caliper control means based on the adjustments made by the coarse caliper control means.

2. The control system of claim 1 wherein the control means adjusts the coarse caliper control means in conjunction with the fine caliper control means to at least partly cancel the effect of the change in the coarse caliper control means by opposed change in the fine caliper control means to produce a bumpless change in the caliper.

3. The control system of claim 1 wherein the coarse caliper control means is a mechanical system for loading the calender.

4. The control system of claim 1 wherein the fine caliper control means is a thermal expansion and contraction based system for adjusting the caliper and nip pressure.

5. The control system of claim 1 wherein the coarse caliper control means controls the loading of the calender in at least two zones.

6. The control system of claim 1 wherein the fine caliper control means controls the adjustment of caliper and nip pressure in a plurality of zones covering substantially the entire cross-directional length of the paper web.

7. The control system of claim 6 wherein the control means moves the coarse caliper control means if more than a specified number of the plurality of zones of adjustment are at one of the limits of the second range of values.

8. The control system of claim 6 wherein the control means moves the coarse caliper control means if the average of the plurality of zones of adjustment has moved more than a specified amount.

9. The control system of claim 6 wherein the control means moves the coarse caliper control means if the range of adjustment of the fine caliper control means would be increased.

10. The control system of claim 6 wherein the control means moves the coarse caliper control means to prevent the fine caliper control means from reaching the limits of the second range of values at any of the plurality of zones of adjustment.

11. The control system of claim 1 wherein the control means controls the fine caliper control means in response to adjustments made by the coarse control caliper means and input from the sensing means.

* * * * *